US007281477B2

(12) United States Patent
Dyson et al.

(10) Patent No.: US 7,281,477 B2
(45) Date of Patent: Oct. 16, 2007

(54) SECURITY APPARATUS

(75) Inventors: Roderick Mark Dyson, Sandton (ZA); James Michael King, Sandton (ZA); Gary Malcolm Keyser, Sandton (ZA)

(73) Assignee: Qube Technology (Proprietary) Limited, Midrand, Gauteng (ZA)

( * ) Notice: Subject to any disclaimer, the term of this patent is extended or adjusted under 35 U.S.C. 154(b) by 0 days.

(21) Appl. No.: 10/493,071

(22) PCT Filed: Oct. 17, 2002

(86) PCT No.: PCT/ZA02/00161

§ 371 (c)(1),
(2), (4) Date: Apr. 16, 2004

(87) PCT Pub. No.: WO03/034351

PCT Pub. Date: Apr. 24, 2003

(65) Prior Publication Data

US 2005/0000396 A1 Jan. 6, 2005

(30) Foreign Application Priority Data

Oct. 17, 2001 (ZA) ..... 2001/8498

(51) Int. Cl.
*E05G 1/00* (2006.01)

(52) U.S. Cl. ..... 109/25; 109/29; 109/37

(58) Field of Classification Search ..... 109/25, 109/29–34, 20

See application file for complete search history.

(56) References Cited

U.S. PATENT DOCUMENTS 1,675,940 A * 7/1928 Lewis ..... 109/20
3,349,729 A * 10/1967 Olivier ..... 109/25
4,202,445 A * 5/1980 Porter ..... 109/29
4,363,279 A * 12/1982 Johansson ..... 109/29
4,607,579 A * 8/1986 Stenild ..... 109/25
5,388,433 A * 2/1995 Andersson et al. ..... 109/25
5,598,793 A * 2/1997 Lopez, Jr. ..... 109/25
5,732,638 A * 3/1998 Van Lint ..... 109/29
6,259,366 B1 * 7/2001 Lindskog et al. ..... 109/25
6,497,186 B1 * 12/2002 Lundblad ..... 109/25
6,564,726 B1 * 5/2003 Lindskog ..... 109/25
7,100,520 B2 * 9/2006 Abe et al. ..... 109/25

FOREIGN PATENT DOCUMENTS

JP 04098387 A * 3/1992
WO WO 01/54078 7/2001

* cited by examiner

*Primary Examiner*—Suzanne Dino Barrett
*Assistant Examiner*—Christopher Boswell
(74) *Attorney, Agent, or Firm*—Fitzpatrick, Cella, Harper & Scinto

(57) ABSTRACT

A security device for transporting monies from a cash acceptance terminal to a bank or similar safe location includes a note tube and a pair of flexible bags containing dye. Cutters operated by explosive devices when an unauthorised attempt is made to break into the note tube pass down the sides of the bags and rip them open. There is provided spring loaded pressure plates which serve to compress the bags to cause the dye to be ejected effectively into the note tube to stain all the notes therein.

15 Claims, 11 Drawing Sheets

SECURITY APPARATUS

This is a national stage of PCT/ZA02/00161 filed Oct. 17, 2002, which claims the priority of South African Application No. 2001/8498, filed Oct. 17, 2001.

This invention relates to security apparatus.

The invention is concerned with apparatus for rendering bank notes unfit for use in the event that these are stolen. The bank notes are rendered unfit for use by applying a stain to the notes rendering them invalid. However unless a very substantial percentage of the area of each side of the notes is not stained there may be debate among lay persons as to whether the notes have indeed been stained and this will result in the miscreant being able to dispose of the stolen notes. Various suggestions have been made for staining such notes but where the notes are contained in stacks, experience has shown that only the edges of many of the notes are stained.

According to one aspect of the invention there is provided security apparatus including a chamber incorporating a rectangular note tube within which a stack of bank notes can be housed, a compartment in the chamber in which a flexible container containing liquid dye can be located and capable of being opened to discharge its contents; connection means adapted to permit the discharged contents to enter the note tube, opening means operable in an emergency situation to open the container, and pressure means, conveniently in the form of spring means, adapted to apply pressure to a container when received within the compartment so that when the container is opened, it, the container, will be caused to discharge a substantial amount of its contents into the chamber.

The emergency situation occurs when an action is taken that indicates an attempt to remove the apparatus from the lawful possessor or when an unauthorised attempt is made to break into the note tube.

Preferably there is a second compartment within the chamber for receiving a second flexible container containing liquid dye, the note tube being preferably located between the compartments. By having the dye containers which are opened as aforesaid, the possibility of all the notes in the note tube being properly stained is increased with a probability of all the notes being so stained.

The opening means preferably comprises a cutter having sharp teeth and a part engaging in a member within compartment and means for driving the cutter along a face of the container from a rest position to an open position to tear open an opening through which dye may escape. The means for driving the cutter preferably comprises a cylinder containing explosive and a piston within the cylinder so that when the explosive ignites, the piston and with it the cutter will be forced down the face of the container from the rest position to the open position. The cutter is preferably formed on a member incorporating a plate parallel to the cutter and preferably on one side of the note tube. The said side of the note tube is preferably provided with an opening which serves as the connection means, the said plate serving to close the opening when in the rest position and not to obscure the opening when moved therefrom so that the dye can escape from the container into the note tube.

The openings are preferably at different heights along the note tube.

According to another aspect of the invention there is provided the combination of apparatus as set forth above with a flexible container containing dye located within the or each compartment.

According to another aspect of the invention there is provided the combination of apparatus as set forth above with a flexible container containing liquid dye, which container is received within the compartment and is subject to pressure from the spring means. The volume of dye within the container is preferably such that when there is a stack of bank notes in the tube, the height of the liquid in the chamber will be the same as the height of the stack. The dye preferably is one having a viscosity of about one.

The opening means preferably comprise a sharp member which can pierce the container and can be drawn down the face of the container so that a substantial opening is formed in the container to enable the dye to be easily expelled therefrom.

The upper end of the note tube is preferably provided with door means which can be armed when in the closed position. Should any attempt be made to force the door means from the closed position this will constitute an emergency situation. The chamber may conveniently comprise wall means that wholly surround the note tube and further have detector means incorporated therein which when an attempt is made to break through the chamber will detect an emergency situation. The apparatus preferably comprises a passive circuit which is energised when an emergency situation applies.

The door means preferably comprises a pair of doors which are hingedly movable from a horizontal closed position where their free ends are in close proximity and a vertical opened position. The means for opening the doors comprise push rods movable by a motor to lift and lower the doors. These push rods are preferably connected to wheels, preferably gear wheels, rotated by the motor so as to move the push rods appropriately. The motor is provided with electric connections extending to the outside of the apparatus whereby power can be provided the motor from a source located outside the apparatus.

The apparatus can with advantage be used with a mobile cash acceptance terminal such as described in South African Patent Specification No 94/4849 and will be filled with monies therefrom. The apparatus can be removed from the terminal to convey its contents to a safe location, such as a bank strong room, where the monies can be removed. As a safety precaution there will be an encryption device in the box and there will be a suitable opening device which cooperates therewith to enable the box to be opened without an emergency situation arising.

An embodiment of the invention will now be described by way of example with reference to the accompanying drawings.

In the Drawings

Figure 4:
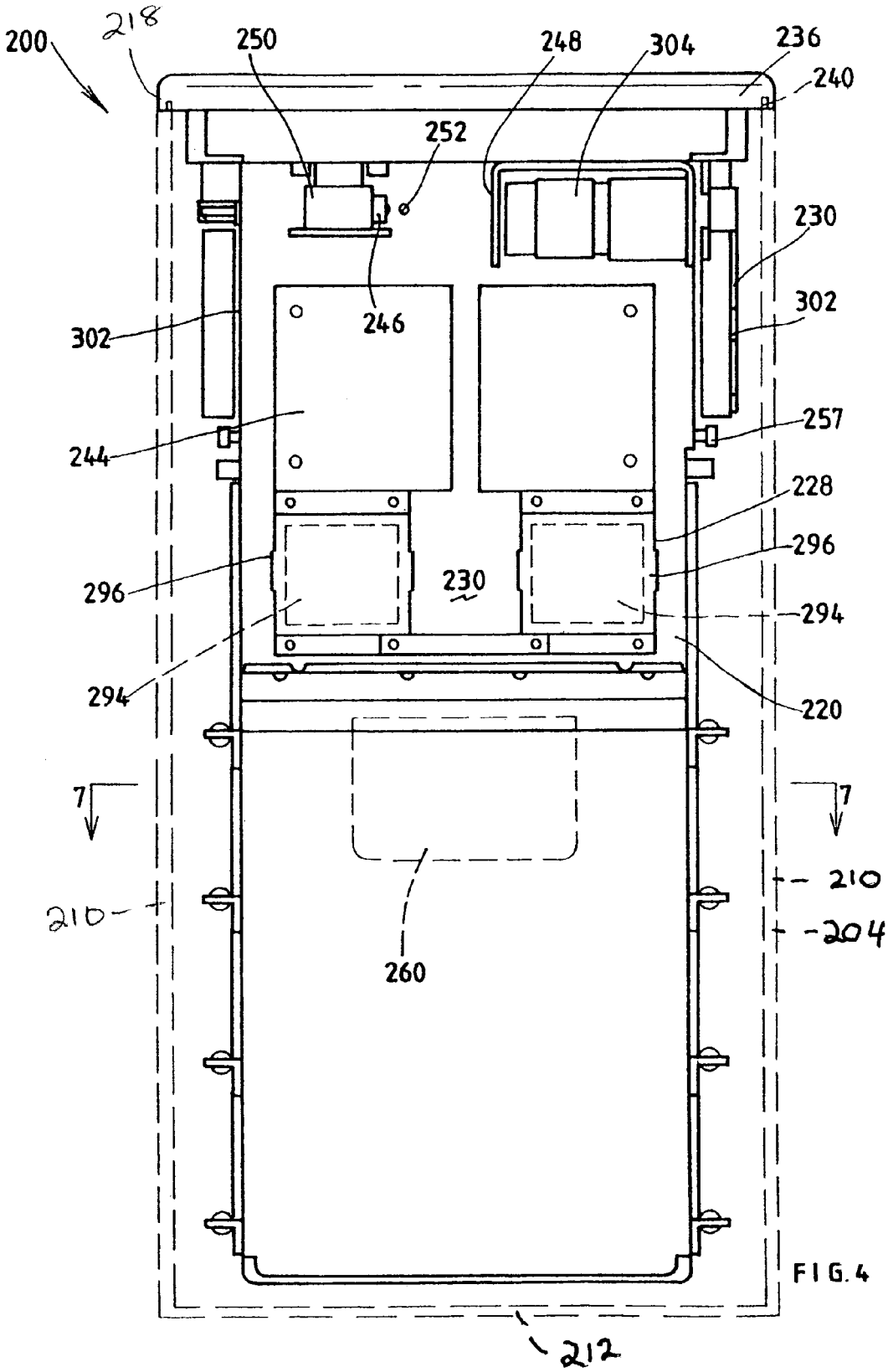
Figure 5:
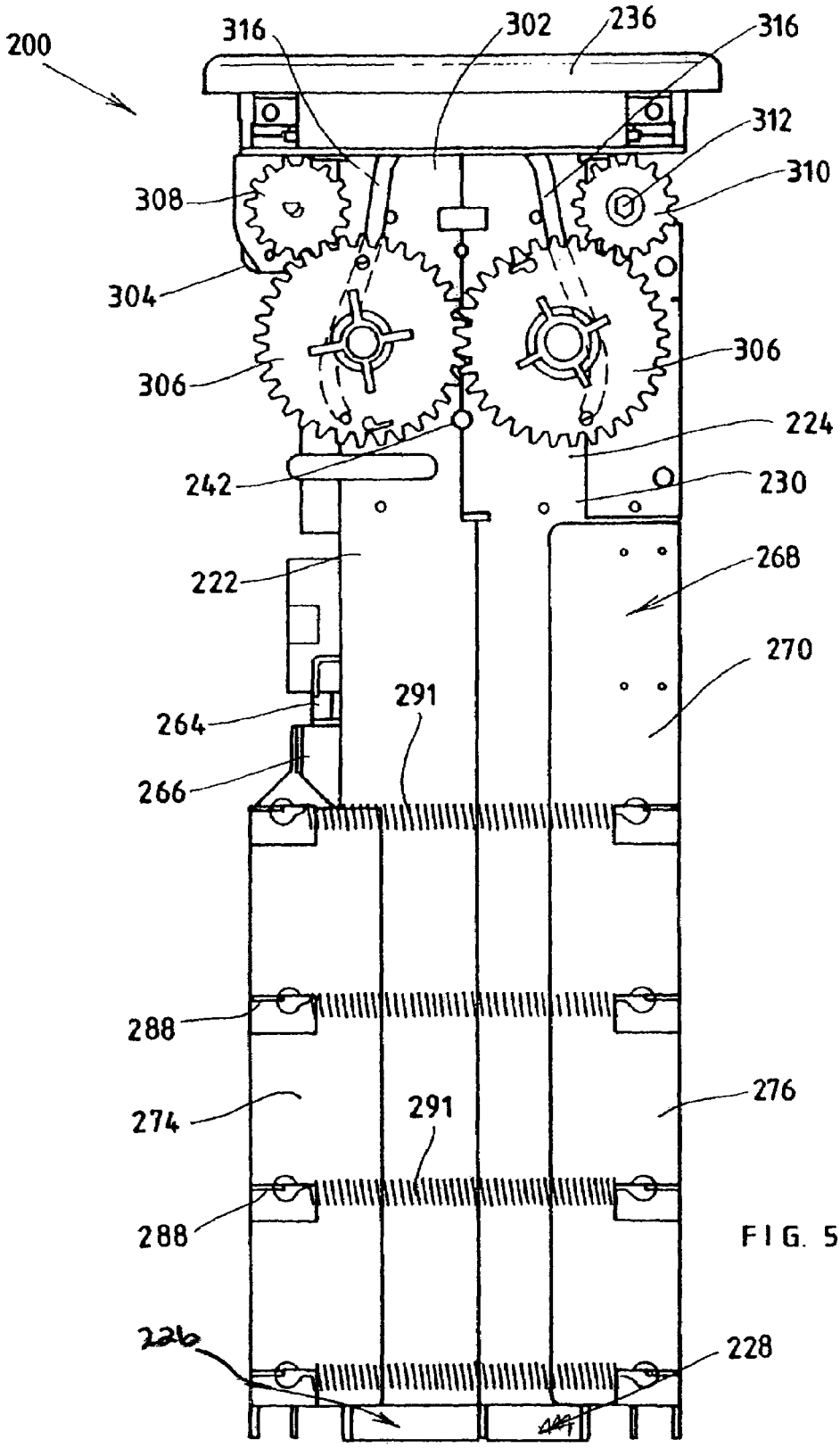
Figure 6:
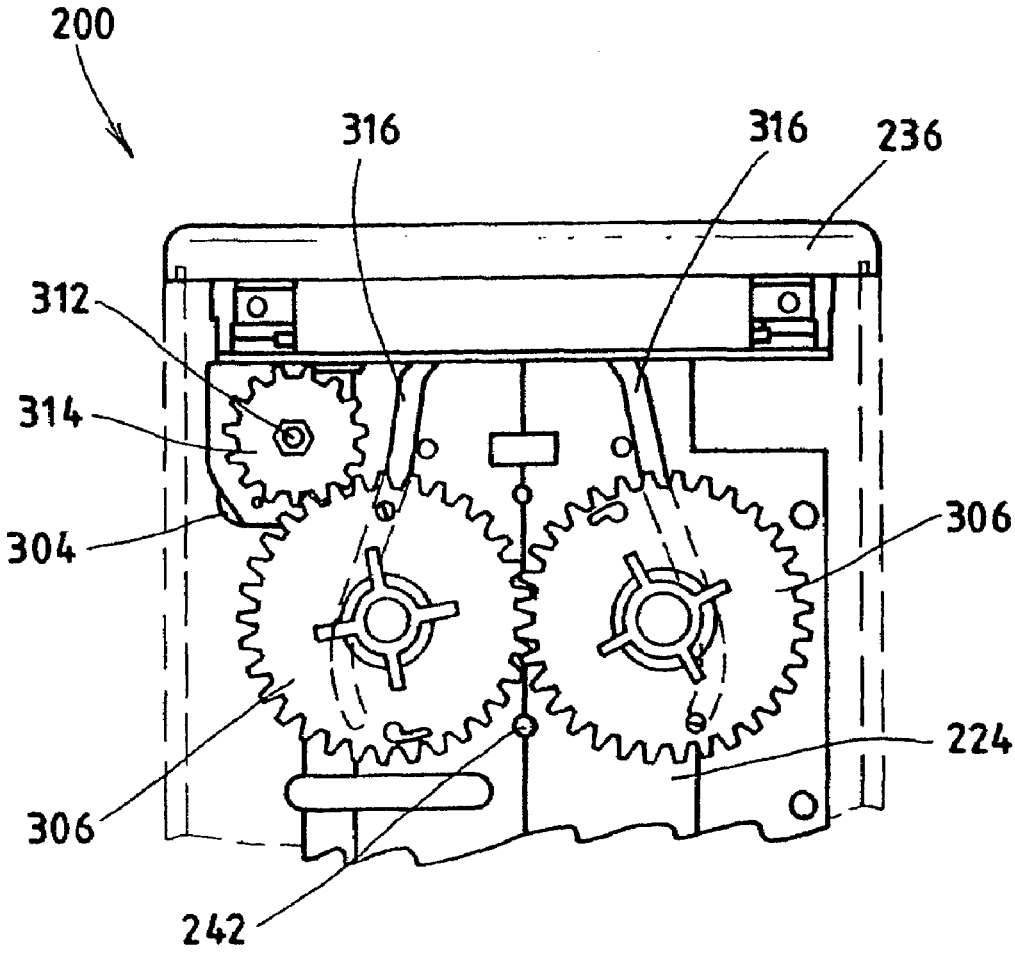
Figure 7:
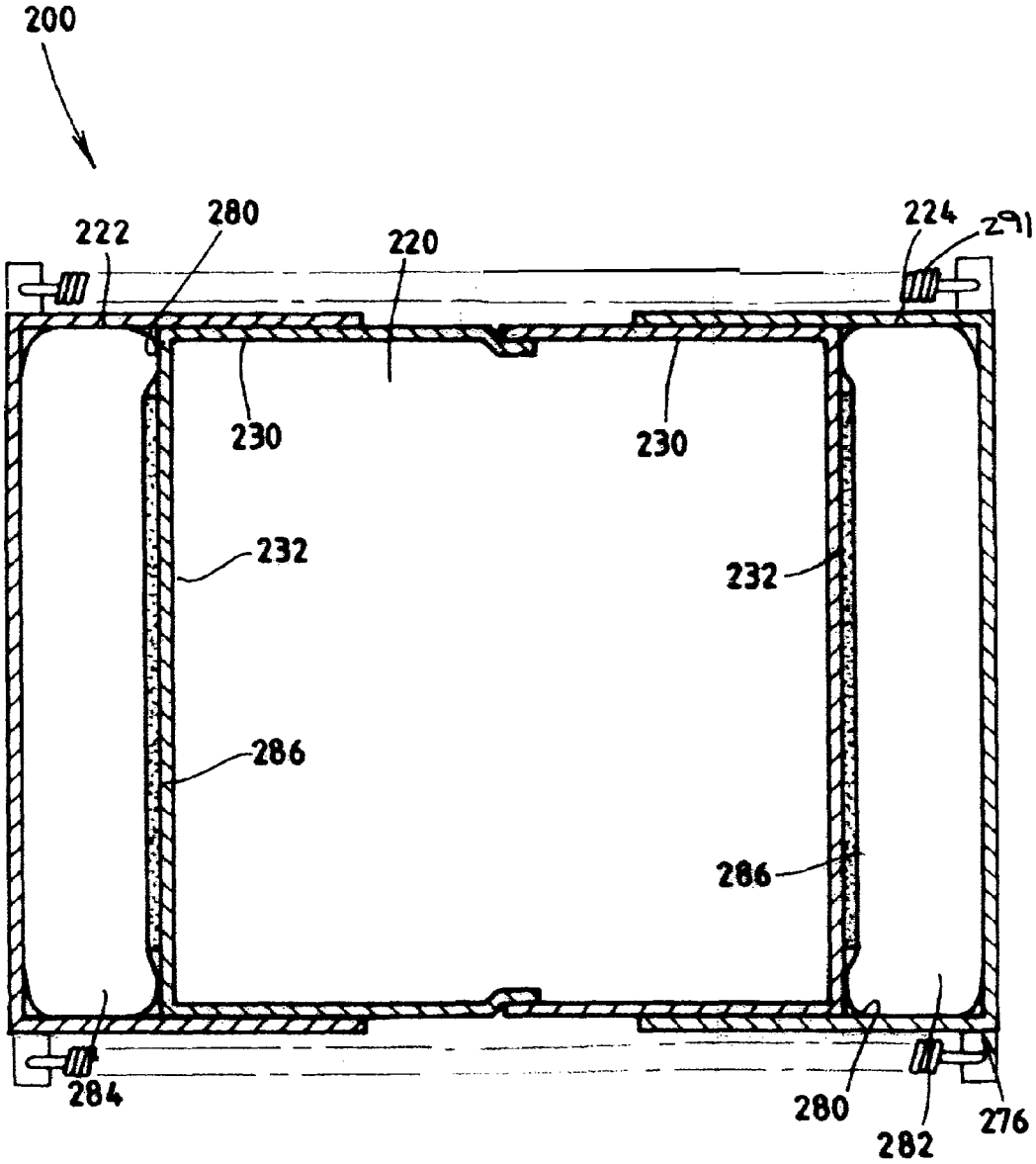
Figure 8:
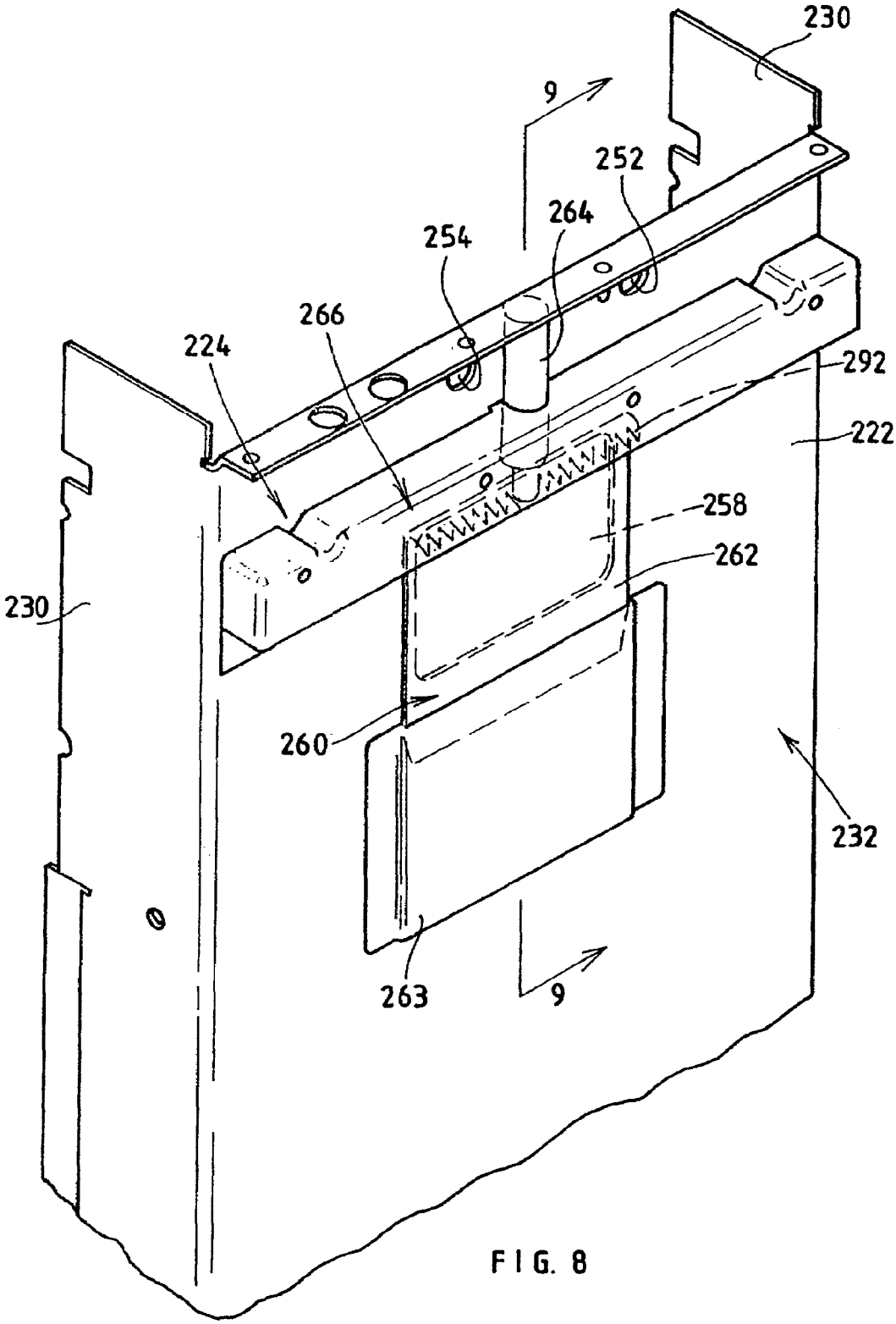
Figure 9:
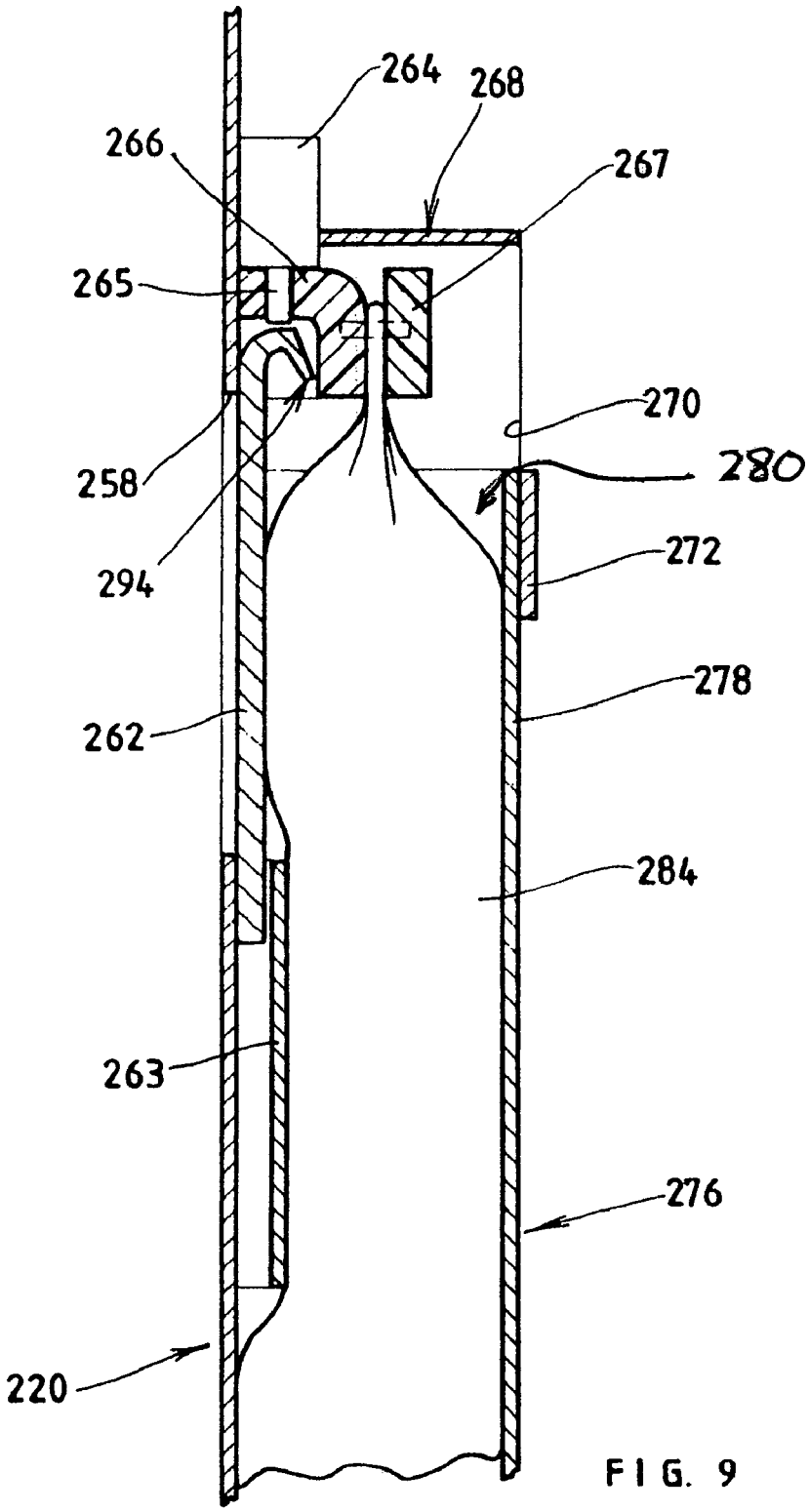
Figure 10:
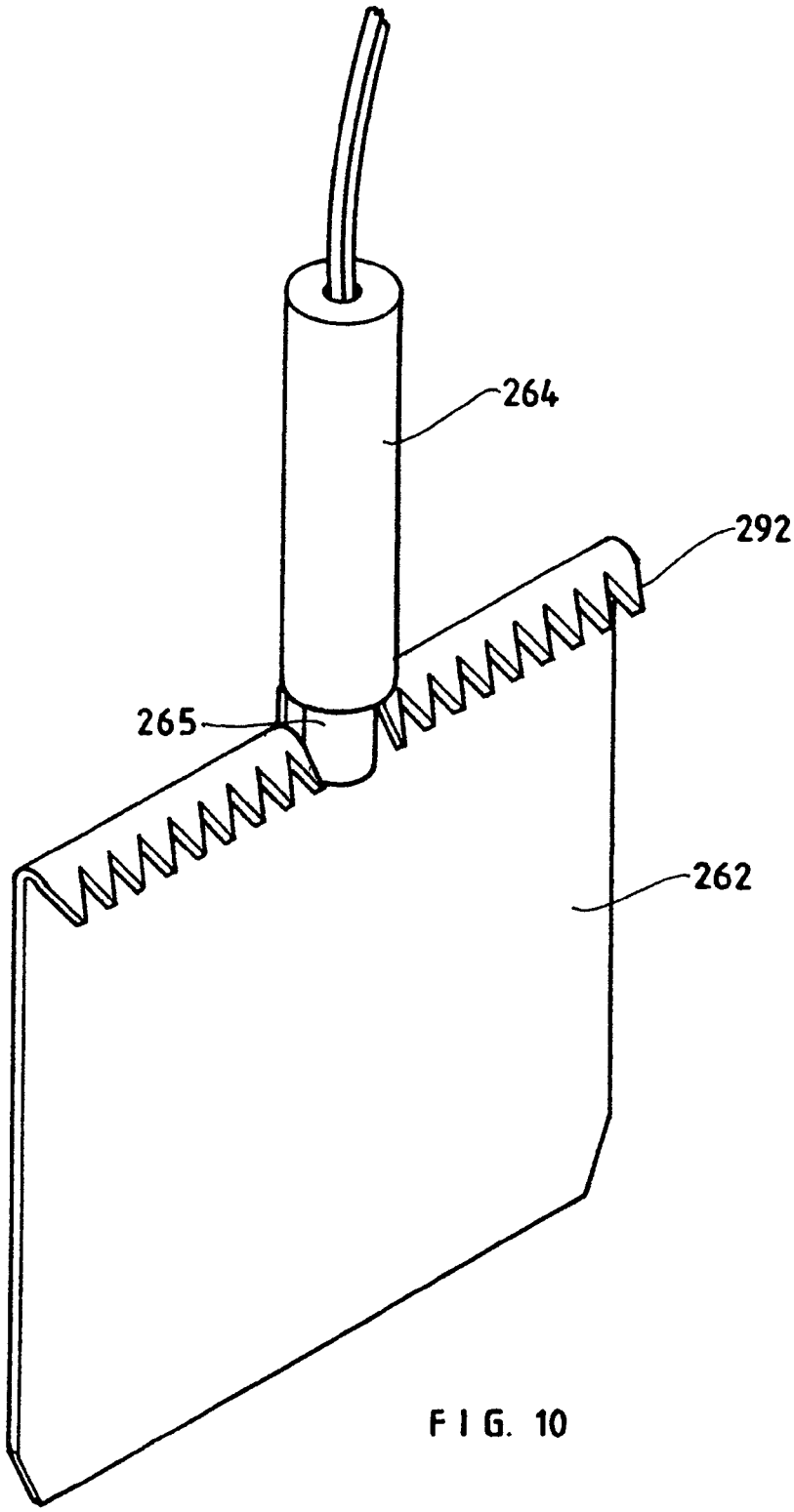
Figure 11:
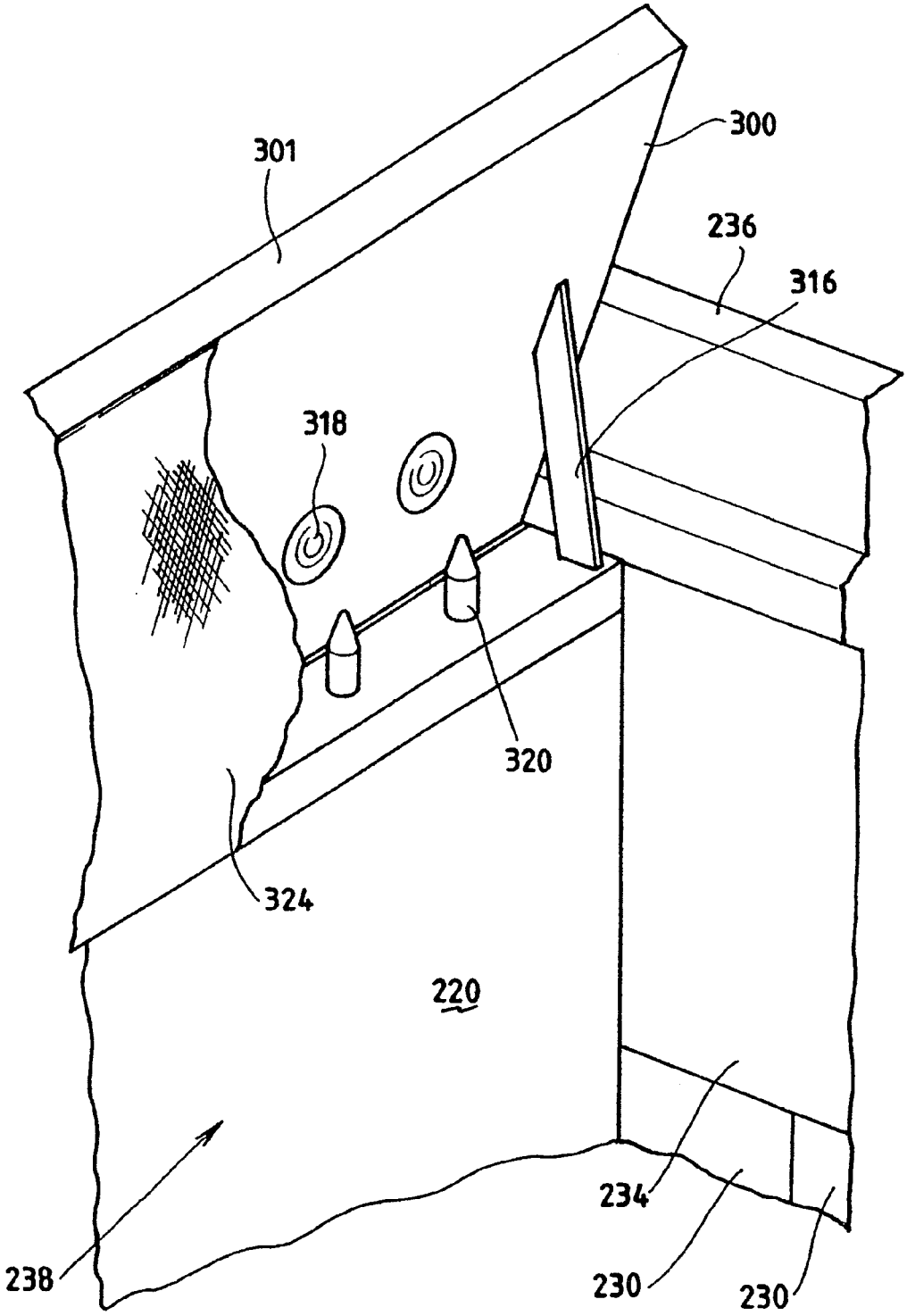

FIG. 4 is a front view of the cash acceptance terminal box with the outside box shown in chain lines, FIG. 5 is a side view of the note tube, FIG. 6 a view from the opposite side of the note tube, FIG. 7 is a section on line 7-7 of FIG. 5, FIG. 8 is a perspective view of a detail of a channel member forming part of the note tube, FIG. 9 is a vertical section of the said detail, FIG. 10 is a perspective view of a plate with serrated teeth, and FIG. 11 is a detail of the door showing various connectors and a cloth guide.

THE MOBILE CASH ACCEPTANCE TERMINAL

Figure 1:
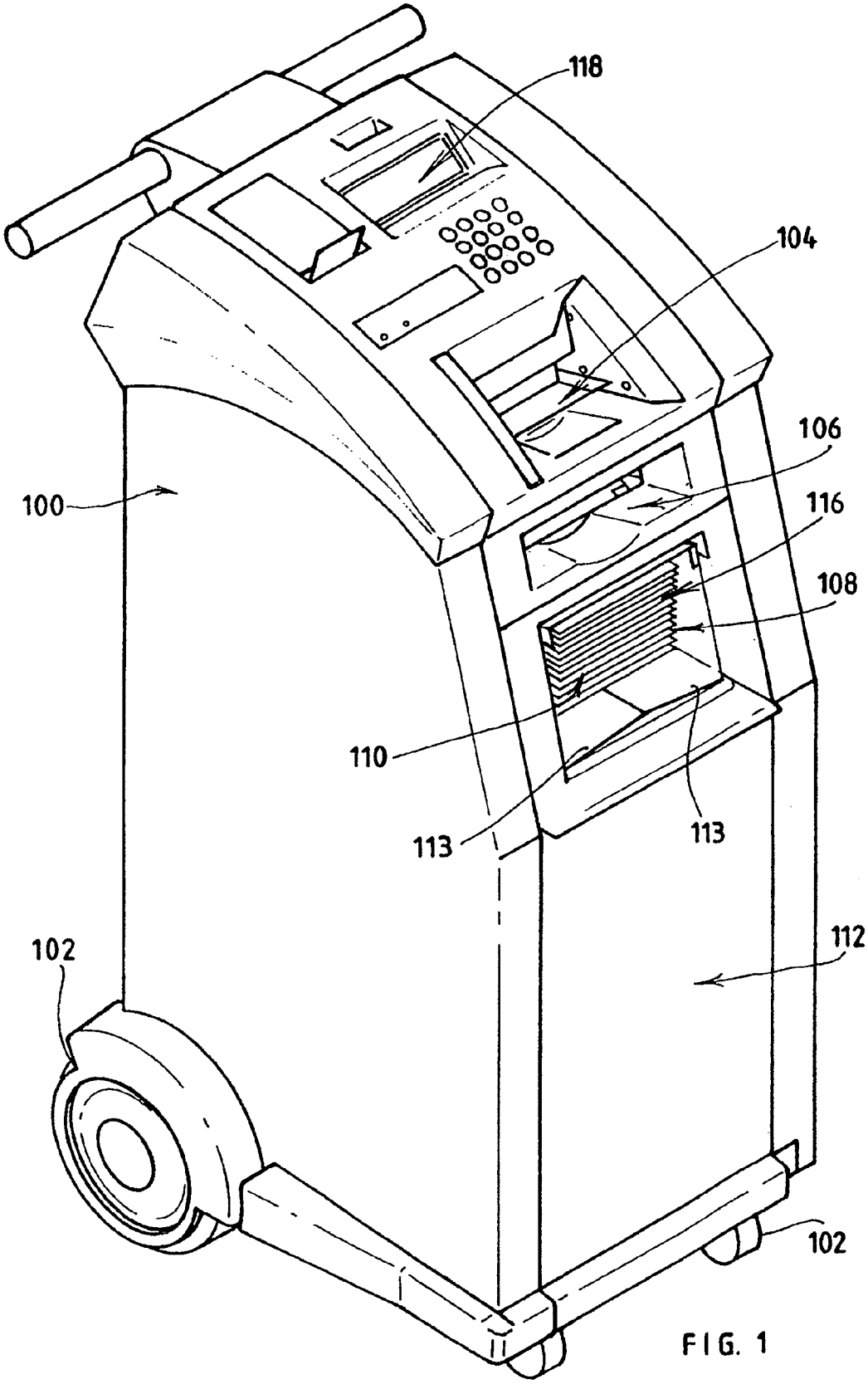
FIG. 1 is a perspective view of a mobile cash acceptance terminal.
Figure 2:
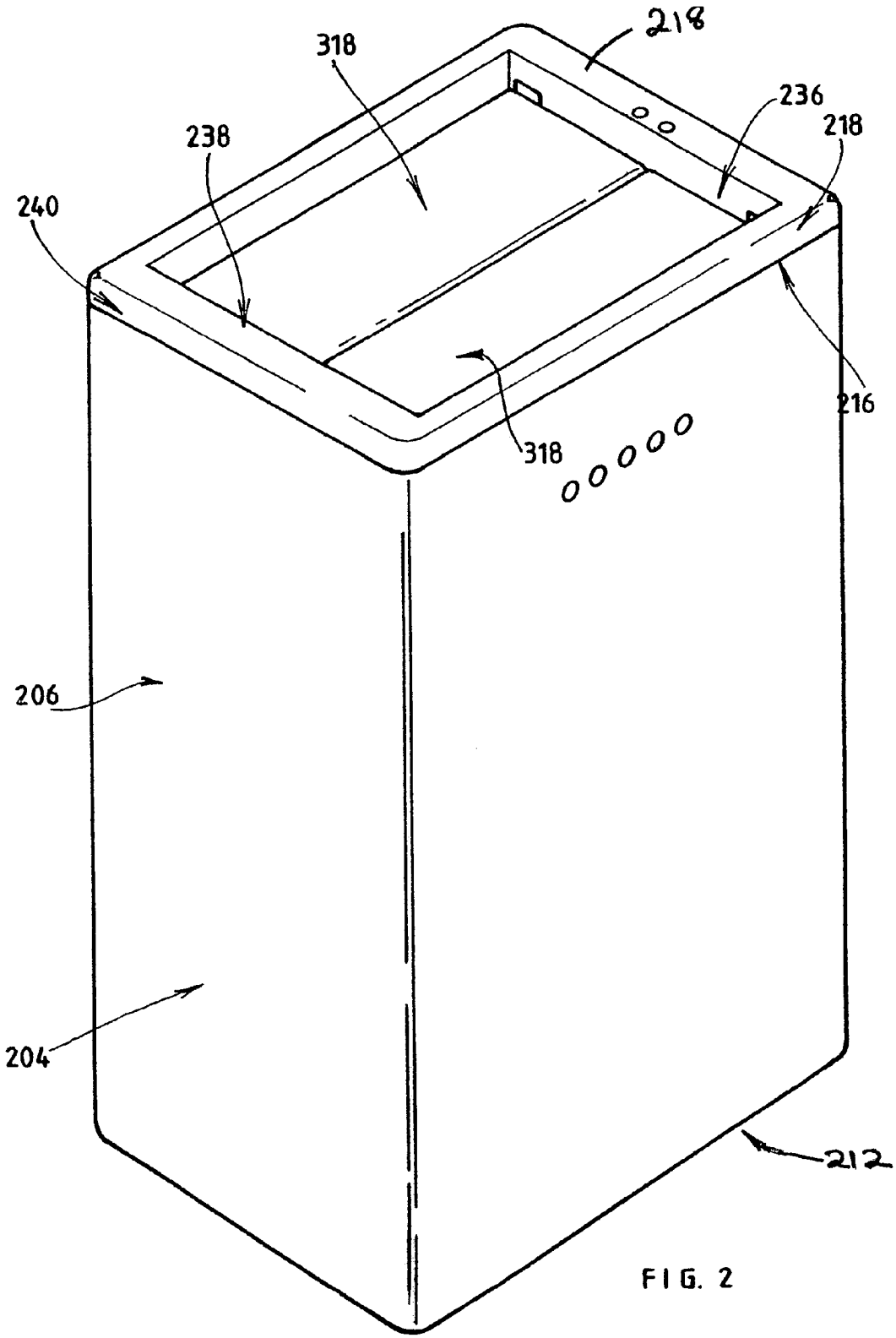
FIG. 2 is a perspective view of a cash acceptance terminal box.
Figure 3:
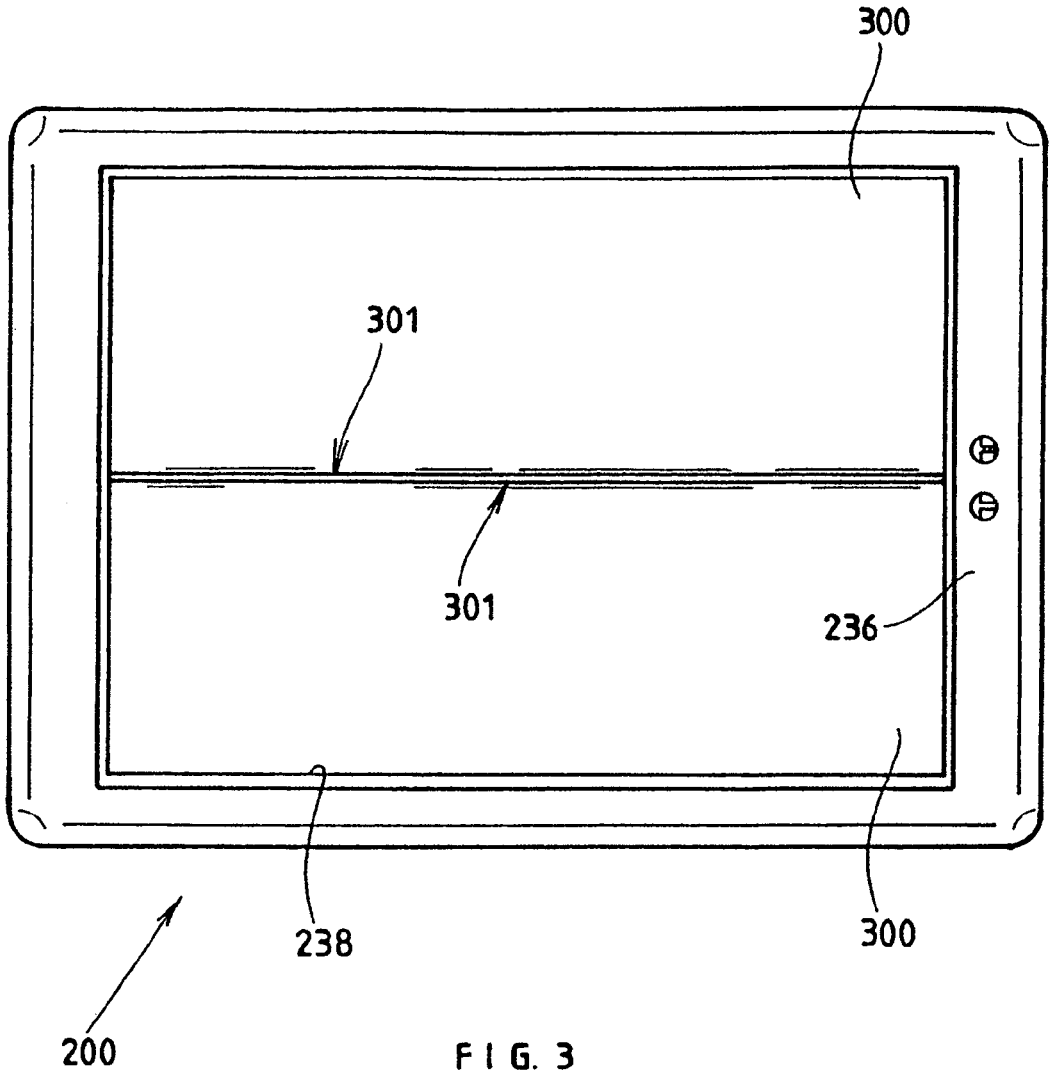
FIG. 3 is a plan of the cash acceptance terminal box.

Referring now to FIG. 1 there is shown a mobile cash acceptance terminal 100 which is mounted on wheels 102 and which can be moved to any appropriate position for reception of monies. The terminal 100 has an inlet portion 104 leading to a note scanner (not shown) which is connected to a reject opening 106 in a wall of the terminal and to an intermediate note receptor 108. There is an outside door 110 in the said wall which is openable as will be described so that the contents of the receptor can be removed. Below the intermediate note receptor 108 is a container 112 within which is removably received a cash acceptance terminal box 200 (hereinafter called a CAT box).

The receptor has a note receiving section the base of which is a delivery opening formed with a pair of trap doors 113. The CAT box 200 has an inlet controlled by a pair of rotary doors 300 (to be described below) which are located directly below the delivery opening.

The terminal 100 comprises suitable electronic devices to operate as will be described. The electronic devices include a display unit 118 and a counter. Notes which are intended to be received within the terminal are fed into the inlet portion 104. The notes are scanned in the scanner which will detect whether the notes are correct and will note their value. Any faulty notes are rejected through the opening 106. The remaining notes are delivered to the note receiving section of the receptor where they are received in the form of a stack. The amount of the notes will appear on the display unit 118. Should the user not be satisfied he will press a button and the door 110 can now be opened and the contents of the intermediate note receptor can be removed. However if the user is satisfied that this correct, he will press an accept button and the stack of notes will be transferred to the CAT box 200 as will be described below. The electronic device will register the amount of money so delivered.

The CAT Box 200

The CAT box 200 comprises an elongated, rectangular section, steel, outside box part 204 defining a chamber 206. Internally the box 204 has a thin wire helix 208 wound around its sides 210 and its base 212 and is embedded in the composite plastic whereof the outside box is moulded. The upper end 216 of the box part 204 has an upstanding rim 218 of slightly smaller dimensions.

Within the chamber 206 is received a rectangular note tube 220 which is of slightly greater cross-section than the area of the largest note it is intended to receive. The note tube 220 formed from two vertical steel channel members 222 and 224, the lower ends of which are received within a base part 226 having an upstanding peripheral rim 228. Each channel member has a pair of arms 230 joined by a web 232. Internal lining side plates 234 are provided at the upper end of tube 220 between the arms 230 of the channel members 222 and 224. A moulded plastic mouth part 236 is provided at and outside the upper end of the tube 220. There is an inlet port 238 in the mouth which is closed by the doors 300. The mouth part 236 has a recess 240 near the periphery of its underside within which the rim 218 is received.

On the sides of the box part 204 are two plate arrangements for opening the doors 300 as will be described. The plate arrangements project beyond the sides of the tube 220. Between the plate arrangements on one side of the note tube 220 there is provided a passive emergency activator 244 incorporating a printed circuit board. A rotary motor 304 is mounted on a bracket 248 connected to the underside of the mouth part 236. A light emitter and detector 250 is located beside the motor adjacent a small opening 252 in the web 230 of the channel member 222 a few millimetres from the top of the box part 204. There is a similar small opening 254 in the web of the other channel member 224 and a light detector 256 close thereto. This serves as an upper level detector. A similar level detector 257 is provided at the lower ends of the plate arrangements 242.

The level detectors serve to send messages to the terminal control to limit the amount of notes that are delivered to the CAT box 200. The lower level detector will send a signal that only a small number (to be determined) of notes may be delivered to the CAT box 200. The upper level detector 250 sends a signal that the CAT box can receive no more notes.

A rectangular opening 258 is provided in the web 232 of the channel member 224 reasonably near to the mouth part. A similar opening 260 is provided in the web of the other channel member 222 about halfway down the length of the tube 220. A movable closure plate 262 is provided for each opening. A guide plate 263 spot welded to the web 232 slidably receives the plate 262 to guide it on its downward movement. The plate 262 is movable in the manner to be described from a rest position in which it obturates the associated opening 258 and 260 and an open position in which it does not obscure the opening. Above each opening is a vertically disposed, electronically operable explosive device 264 which is connected to the closure plate 262 by a pin 265.

A transverse plastic bar 266 is secured to the web of the channel member 224. A second bar 267 is secured to the bar 266 to clamp the upper edge of the bag or container 284 (to be described below) to the side of the tube 220. A channel shaped cover 268 overlies the bar 226 and has arms 270 extending under the plate arrangements 242. The outer edges of these arms are bent inwardly to provide locating rims 272.

Outside channel members 274 and 276 are slidable on the outsides of the channel members 222 and 224. The web 278 of the outside member 276 extends to the top of the tube 220 and its edges fit under the rims 272. The outside member 274 extends to about midway of the tube and above the opening 260. The webs of the two outside members 274 and 276 are spaced from the webs of the channel members 222 and 224 to form dye compartments 280 within which flexible bags or containers 282 and 284 are contained. These containers 282 and 284 are held in position by double sided adhesive tape 286 holding them to the webs of the members 222 and 224. The upper edge of the bag 284 is clamped as aforesaid. The upper edge of the container 282 is similarly clamped.

The arms 286 of the outside members 274 and 276 have projecting lugs 288 close to the webs 290. Tension springs 291 join the lugs 288 of the members 274 and 276 drawing them towards each other so that the webs 290 of these members constitute pressure means to apply pressure to a flexible containers when received within the dye compartments 280.

The upper end of each closure plate 262 is provided with sharp serrated teeth 292. These teeth 292 are received in a recess 294 in the bar 266 when the plate 262 is in the rest position. The bar 266 thus serves as a scabbard to shield and protect the adjacent container from the teeth. When the plates 262 are moved by the explosive devices 264 the teeth 292 come into contact with the flexible containers to tear the containers open. The dye is forced out of the containers by the pressure means and passes through the openings 260, from which the plates 262 now in their open positions have moved, serve as connection means to permit the discharged dye to enter the note tube 220.

The volume of dye within the containers is such that when there is a stack of bank notes in the tube, the height of the liquid in the chamber will be at least the same as the height of the stack and preferably more. The dye preferably is one having a viscosity of close to that of water i.e. one.

Because the upper edge of the bag 284 is clamped as aforesaid, and also because the bag 284 is held in place by the double sided tape, the bag will not be drawn down during the movement of the cutter.

The CAT box 200 incudes electronic means (not shown) to receive a signal indicating the amount of money received in the note tube. The electronic means can be read by suitable equipment at the location where the CAT box is unloaded so that there is a correct and proper indication of monies received.

Because the note tube is of slightly greater dimension to the notes and also because the notes are dropped by the double trap door 113, the notes fall by gravity into the note tube and will normally settle in the form of a stack.

Batteries 294 held in holders 296 serve to power the passive emergency activator 244 and to actuate the explosive devices 264 when the activator 244 detects an emergency situation.

The Doors 300

The doors 300 are pivoted to the mouth part 236 at their outer edges 301. They are capable of moving from a horizontal closed position to a vertical open position. When in the closed position their edges are close together.

The plate arrangements each include an outside plate 320 spaced from the sides of the note tube 220. The outside plate carries two large meshing gear wheels 306. On one plate arrangement there are two pinions 308 and 310 located slightly above and to the outer sides of the gear wheels 306. The pinion 308 is mounted on the shaft of the motor 304. The other pinion 310 is carried on one end of a cross shaft 312 which carries a similarly positioned pinion 314 at the other plate arrangement meshing with one of the gears 306 on this plate arrangement.

Push rods 316 are pivotally connected between each gear wheel 306 and the adjacent edge of the nearer door 300. These push rods lie between the gear wheels 302 and the side of the note tube 220. When the gears are positioned so that the ends of the push rods 316 are low down (as shown in FIG. 5), they, the push rods 316 hold the doors 300 in their closed position. In this position the push rods 316 are in an over-centre position so that the door is self locking. On rotation of the motor 304, the pinion 308 moves the gear wheels 306 to lift the lower ends of the push rods 316 to move the doors 300 into their open position.

The motor 304 is provided with outside studs which when the apparatus in the terminal is connected to a power source for operating motor to open and close the doors 300.

Each door 300 carries a pair of electrically connected copper studs 318 on its underside. The mouth part 236 carries a pair of conical connector pins 320 which are engaged by the studs 318 when the doors are in their closed position. An attempt to force the doors open when in their closed position and the apparatus is armed will break the circuit formed by the pins and studs to activate the passive emergency activator 244 which will then recognise an emergency situation and act accordingly.

In order to prevent notes inadvertently falling between the contacts 318 and 0.320 which may prevent the apparatus from being armed, a length of plasticised canvas 324 is provided between the free ends of each door and the edge of the inlet port 238. This cloth will be stretched when the doors 300 are open to guide any misdirected note into the note tube 220.

The invention is not limited to the precise constructional details hereinbefore described and illustrated in the drawings.

The invention claimed is:

1. A security apparatus including:

a chamber incorporating a rectangular note tube within which a stack of bank notes can be housed;

a first compartment in the chamber in which a flexible container containing liquid dye can be located and capable of being opened to discharge its contents;

a second compartment within the chamber for receiving a second flexible container containing liquid dye;

connection means between said note tube and at least one of said compartments adapted to permit the discharged contents of at least one of the containers to enter the note tube;

opening means operable in an emergency situation to open the at least one container; and pressure means adapted to apply pressure mechanically to the containers when received within the compartments so that when the containers are opened the containers will be caused to discharge a substantial amount of their contents into the note tube, wherein the pressure means comprises a pair of movable plates respectively forming one wall of the two compartments, the plates being biased towards the note tube which forms another wall of each compartment, and two movable channel shaped members each comprising one of the movable plates extending between two arms at right angles thereto.

2. The apparatus as claimed in claim 1, wherein the note tube is located between the compartments.

3. The apparatus as claimed in claim 1, wherein there is a second connection means to permit contents of the second container to enter the note tube.

4. The apparatus as claimed in claim 3, wherein the two connection means open into the note tube at different heights.

5. The apparatus as claimed in claim 1, wherein the opening means comprises a cutter movable in a cutting direction from a rest position to an open position, the cutter having a set of sharp teeth extending transversely to the cutting direction, and means for driving the cutter along a face of at least one of the containers from the rest position to the open position to tear open an opening through which dye may escape.

6. The apparatus as claimed in claim 5, wherein the means for driving the cutter comprises a cylinder containing explosive and a piston within the cylinder, the piston operatively engaging the cutter so that when the explosive ignites, the piston and with it the cutter will be forced down the face of at least one of the containers from the rest position to the open position.

7. The apparatus as claimed in claim 5, wherein the cutter incorporates a cutter plate having one edge extending transversely to the cutting direction, said set of sharp teeth being formed on said one edge.

8. The apparatus as claimed in claim 7, wherein the cutter plate is located on one side of the note tube.

9. The apparatus as claimed in claim 8, wherein the one side of the note tube is provided with an opening which serves as the connection means, the cutter plate serving to close the opening when in the rest position and not to obscure the opening when moved therefrom so that the dye can escape from at least one of the containers into the note tube.

10. The apparatus as claimed in claim 5, further comprising guide means to guide the cutter during movement from the rest position to the open position.

11. The apparatus as claimed in claim 1, wherein the pressure means incorporates spring means.

12. The apparatus as claimed in claim 1, wherein the two channel shaped members are connected together by spring means to bias them towards the note tube.

13. The apparatus as claimed in claim 1, wherein the chamber incorporates a woven wire mesh which will be broken if an attempt is made to break into the chamber.

14. The combination of the apparatus as claimed in claim 1 with a flexible container containing dye located within each compartment.

15. The combination of claim 14, wherein each container is clamped at its upper side relative to the note tube.

* * * * *